US012213607B2

(12) United States Patent
Miah et al.

(10) Patent No.: US 12,213,607 B2
(45) Date of Patent: Feb. 4, 2025

(54) FOOD PRODUCT HOLDER

(71) Applicants: Ismail Miah, London (GB); Mohammed Islam, Dagenham (GB)

(72) Inventors: Ismail Miah, London (GB); Mohammed Islam, Dagenham (GB)

( * ) Notice: Subject to any disclaimer, the term of this patent is extended or adjusted under 35 U.S.C. 154(b) by 297 days.

(21) Appl. No.: 17/604,938

(22) PCT Filed: Apr. 21, 2020

(86) PCT No.: PCT/IB2020/053766

§ 371 (c)(1),
(2) Date: Oct. 19, 2021

(87) PCT Pub. No.: WO2020/217169

PCT Pub. Date: Oct. 29, 2020

(65) Prior Publication Data

US 2022/0225805 A1 Jul. 21, 2022

(30) Foreign Application Priority Data

Apr. 22, 2019 (GB) ..... 1905617

(51) Int. Cl.
*A47G 21/00* (2006.01)

(52) U.S. Cl.
CPC ..... *A47G 21/001* (2013.01)

(58) Field of Classification Search
CPC ..... B65D 21/086; A47G 21/001; A47G 2021/002; A47J 43/00
(Continued)

(56) References Cited

U.S. PATENT DOCUMENTS 2,145,481 A 1/1939 Harvey
D901,984 S * 11/2020 Lakatos ..... D7/602
(Continued)

FOREIGN PATENT DOCUMENTS

AU 2004200027 B2 1/2004
AU 2012323770 A1 10/2021
(Continued)

OTHER PUBLICATIONS

International Search Report Issued from the European Patent Office within the PCT Application No. PCT/IB2020/053766, Jun. 10, 2020, 4 pages.
(Continued)

*Primary Examiner* — Stephen J Castellano
(74) *Attorney, Agent, or Firm* — Schott, P.C.

(57) ABSTRACT

The device herein overcomes the problem of holding a messy food item by providing a food holder having corrugations of resilient material, where the corrugations are arranged to provide, in use, a compressive force to hold the food in place. The food holder has two opposing sides joined by a gusset, the gusset having corrugations of resilient material, where the corrugations are arranged to provide, in use, a compressive force to hold the food in place. The opposing sides have an open edge and at least one closed edge where the gusset joins the sides together along at least one closed edge, and where the gusset is arranged to allow all of the edges of the opposing sides to move towards and away from each other. The container is of one-piece construction and the corrugations are semi-circular, and the proportions of adjacent corrugations are different.

6 Claims, 4 Drawing Sheets

(58) Field of Classification Search
USPC ..... 220/666
See application file for complete search history.

(56) References Cited

U.S. PATENT DOCUMENTS

| | | | | |
|---|---|---|---|---|
| 2004/0206756 | A1* | 10/2004 | Maia | B65D 43/162 220/4.23 |
| 2006/0131310 | A1 | 6/2006 | Lau | |
| 2006/0266754 | A1* | 11/2006 | Carmona | A47J 47/02 220/666 |
| 2007/0256751 | A1* | 11/2007 | Kellner | F16L 11/15 138/121 |
| 2011/0042395 | A1* | 2/2011 | Vanderberg | F25D 3/06 220/666 |

FOREIGN PATENT DOCUMENTS

| | | | |
|---|---|---|---|
| ES | 2194581 | A1 | 11/2003 |
| WO | 8505612 | A1 | 12/1985 |
| WO | WO-98/35598 | * | 8/1998 |

OTHER PUBLICATIONS

Examination Report Issued from the UK Intellectual Property Office within the Great Britain Application No. GB1905617.5 dated Oct. 18, 2019, 7 pages.

* cited by examiner

FOOD PRODUCT HOLDER

BACKGROUND

Field of the Invention

The invention is in the field of equipment for serving food and particularly relates to holders for food typically eaten using fingers.

Description of Related Art

A characteristic of food eaten using fingers, rather than with a knife and fork, is that it can be messy to eat because of its complexity, for example burgers. Burgers are a composite food item comprising a central core of a patty, i.e. a thick disk of food filling such as a processed meat or vegetable product, sandwiched between an upper and lower bread component, each also generally of thick disk shape. Further fillings may be included such as salad, cheese, other meats, relishes, sauces and pickles to create a cylindrical layered food item. The overall shape of the burger food product is a short cylinder having relatively flat top and bottom surfaces with generally parallel sides. It is relatively stable when resting on its bottom surface. This stack of layers is unstable and prone to disintegrate while being eaten.

Conventionally, burgers are served on a plate or in a box and the burger is lifted to the mouth using fingers. A napkin may be wrapped around the burger to prevent it from coming apart, but this can get soggy, disintegrate and get in the way of the food itself.

It is therefore an object of the invention to overcome the problem of holding a messy food item without it disintegrating.

SUMMARY OF THE INVENTION

The invention provides a food holder having two opposing sides joined by a gusset, the gusset having corrugations of resilient material, where the corrugations are arranged to provide, in use, a compressive force to hold the food in place and wherein each of the opposing sides has an open edge and at least one closed edge, and wherein the gusset joins the sides together along the at least one closed edge, wherein the gusset is arranged to allow all edges of one side to move towards and away from all edges of the other side, wherein the container is of one-piece construction, wherein the corrugations are semi-circular, and wherein the proportions of adjacent corrugations are different.

The container holds the food with a spring-like force and provides a grip on the food. The two opposing sides of the container joined by a corrugated gusset provide articulated faces for the user to hold. Each side may have a notch for exposing a food item in use for the user to bite into. A rim may be provided around the notch of thickness greater than the rest of each side.

Each side may have a curved edge and the gusset joins the sides together along the curved edge.

Each side may have protrusions to stabilise the container when resting on the curved gusset.

Each side may have two straight edges that meet at an angle and the gusset joins the sides along the two straight edges. Alternatively, each side may have three straight edges and the gusset joins the sides along the three straight edges.

For semi-circular corrugations, the radius of alternate corrugations are equal and the radius of adjacent corrugations differ by a factor of at least 1.5. This provides a double-radiused corrugation effect, where the set of corrugations of greater radius allows expansion of the gusset, while corrugations of lesser radius provides a greater component of compressive force.

The holder may be made from silicon rubber or a thermoplastic elastomer and may be one-piece injection moulded.

In a further embodiment, a method is provided comprising the steps of opening the sides of the food holder, inserting a food item and releasing the sides to allow the sides of the food holder to grip the food item.

DETAILED DESCRIPTION OF THE PREFERRED EMBODIMENT

The food holder is a portable container for food items, particularly burgers. It is of one-piece construction and has expandable sides that are made of fluted resilient material. The expandable sides can fit different sized food items and provide a compressive force to retain the food and help prevent the food coming apart during its consumption. The food holder allows the food to be served on its side.

Figure 1A:
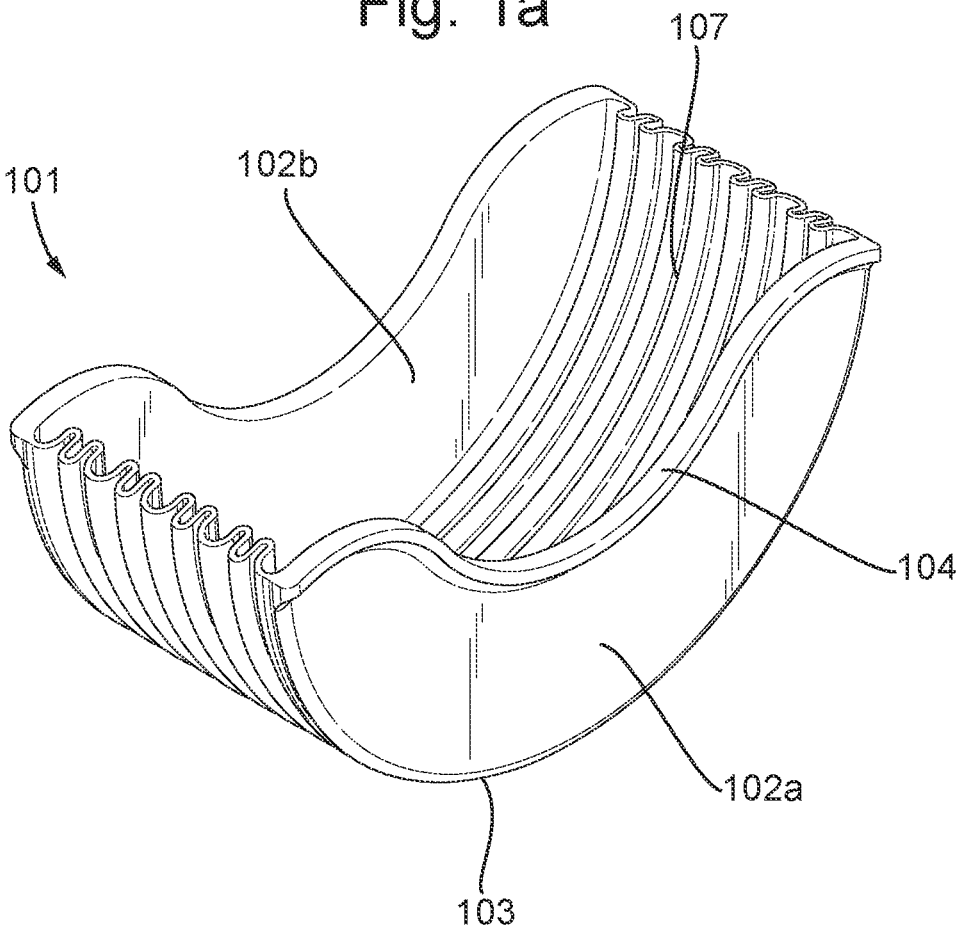
FIG. 1*a* is a perspective view of a food holder in accordance with an embodiment of the invention.
Figure 1B:
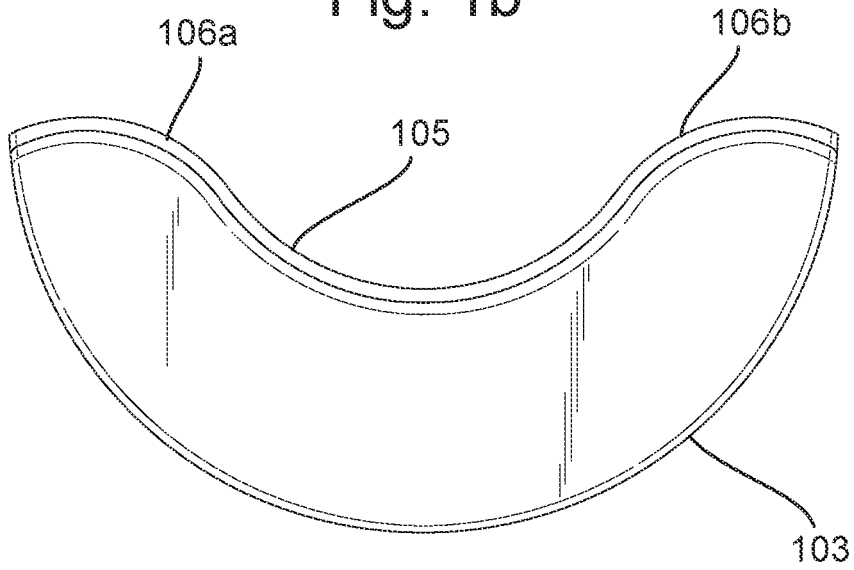
FIG. 1*b* is a side view of the food holder shown in FIG. 1*a*.

FIGS. 1*a* and 1*b* show an embodiment of the food holder 101. The food holder has opposing flat faces 102*a*, 102*b*. Each face has an edge with two distinct profiles; a first edge 103 which has a semi-circular profile that defines the outer periphery of each face; and a second edge 104 that is a compound curve, having a central part 105 that is a part of a circle having the same radius as the first edge 103 and two transition parts 106*a*, 106*b* of opposite curvature to the central part 105, joining the second edge 104 to the first edge 103 and meeting at an angle of approximately 90 degrees. The compound curve of the second edge 104 defines a U-shaped notch, a cut-out central section exposing the maximum amount of food item to a users bite while providing sufficient support for it.

The opposing flat faces 102*a,b* are connected by an intervening expandable elastic gusset 107, joined along the first edge 103 of each opposing face. The gusset 107 is semi-circular in shape and defines a curved side to the food holder 101. The curve allows a burger to nest within the food holder.

Figure 2A:
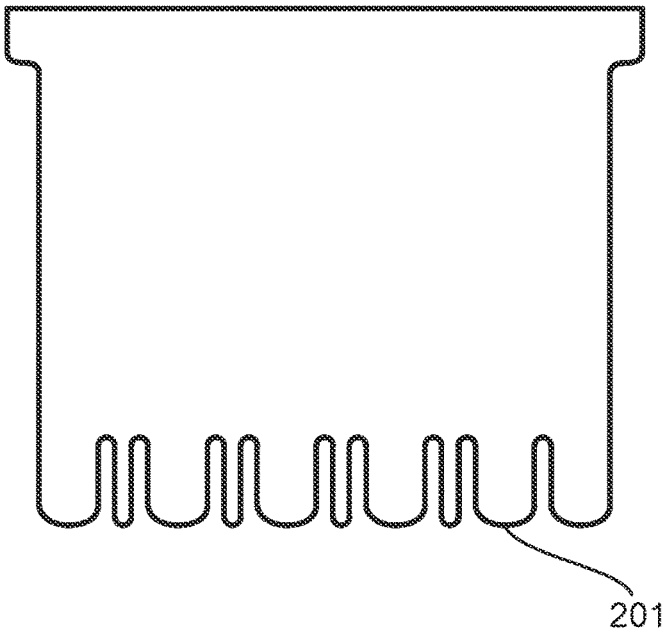
FIG. 2*a* is a cross sectional view of the food holder shown in FIG. 1*a*.

The arrangement of the expandable elastic gusset 107 is shown in more detail in FIG. 2*a*. The gusset has a stretch system and is formed of a series of parallel fluted folds 201, or convolutions, or corrugations of semi-circular profile, running parallel to the first edges 103 of each opposing face. The overall shape of the holder is thus of a short gutter with flat ends and concertina-like walls. The convolutions of the gusset 107 allow a degree of relative movement between the opposing flat faces, primarily toward and away from each other. The corrugated resilient material provides a reactive force when the flat faces are separated and the holder then exerts a compressive force on food items that are wider than the holder in its resting state.

Figure 2B:
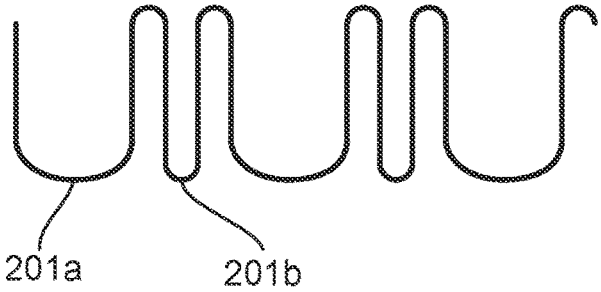
FIG. 2*b* is a detail of the cross sectional view of FIG. 2*a*.

The folds are structured with alternate wide and narrow flutings, 201*a, b* shown in FIG. 2*b*. In this embodiment there are five wide flutings with four intervening narrow flutings. The wide flutings 201*a* have a radius that is approximately twice that of the narrow flutings 201*b*. This arrangement provides a dual effect; the wide flutings allow for expansion of the holder, while the narrow flutings provide greater resilience and therefore compressive force to hold the food in place.

The wall thickness of the flutings 201 is half the thickness of the opposing flat faces 102, because the flat faces 102 have a degree of stiffness for support while the gusset 107 is flexible. The flat faces 102 are also provided with a rim running along their second edges 104 to provide reinforcement so that the holder maintains its shape during use and also provides the user with a touch cue to prevent them biting into the holder. The flat faces 102 are nevertheless still soft and flexible.

Figure 3:
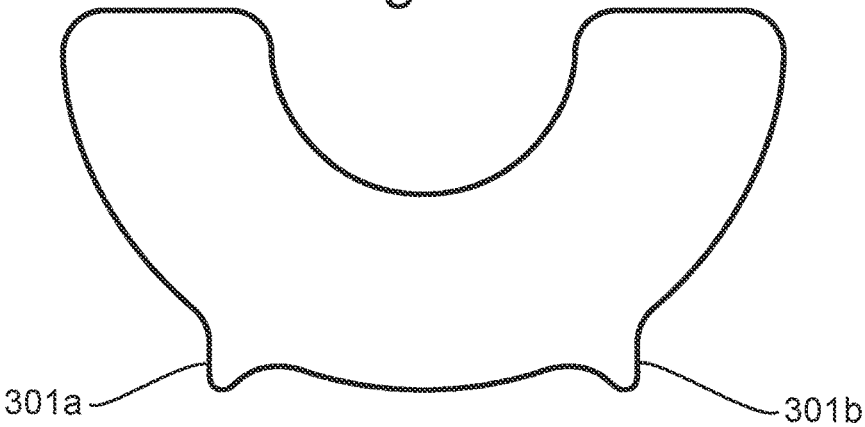
FIG. 3 is a side view of a further embodiment having protrusions for stabilising the food holder.

A feature of the holder is that food items like burgers can be served and rested between bites on their side, as opposed to on the bottom surface. This has the advantage of being able to display the layers of the burger food product and also more items can be placed on a serving tray, which is particularly helpful in fast food outlets. Food such as burgers can be consumed without the need of a plate which is helpful for people on the move. The holder makes it much more convenient to pick up and put down food and to dip into sauces, or to hold the food while sauces are squeezed onto the side of the food prior to a bite being taken. The outer surface of the flat faces 102 may be provided with protrusions 301*a*, 301*b* shown in FIG. 3 to prevent the holder from rolling from side-to-side when standing on its side.

Typical dimensions for the food holder at rest are an overall diameter of 120 mm and an internal width of 55 mm, which reflects the standard dimensions of a burger. When stretched, the width of the holder can increase to 130 mm. The wide flutings 201*a* have a radius of 3 mm, while the narrow flutings 201*b* have a radius of 1.75 mm. These dimensions are for illustration of a particular embodiment only and many other sizes and proportions are possible without departing from the spirit of the invention as an expandable food holder.

In use, an appropriately sized food holder is selected for the food item to be held. For example a 120 mm diameter, 60 mm height burger, a 120 mm diameter, 55 mm food holder is selected, i.e. the food holder is substantially the same diameter as the burger but when at rest it is slightly narrower than the burger. The food holder is then expanded by hand against the resilient force of the gusset and the burger inserted into the food holder. When released, the holder then closes slightly against the burger to gently grip it. The bottom of the food holder may be squeezed to push up the burger.

The food holder is of one-piece construction, which has the advantage of preventing any leakage of liquids, the holder acting as a dish. It is injection moulded using a thermoplastic elastomer (TPE) of food grade, such as ENSOFT SO-161-30A from Enplast®, or alternatively food grade silicon rubber, selected because it they are non-toxic, odourless and tasteless and also resistant to high temperatures up to 220° C. making it suitable for all types of dishwashers, including heavy-duty commercial dishwashers. These materials are also very difficult to damage and therefore suitable for the rigors of commercial food production environments and can be reused many times.

The elastic sides of the food holder have the advantage that they can exert a gentle compressive force on food items to retain complex multi-layered food products and prevent them from coming apart while being eaten and therefore greatly reduce the mess often made while eating complex foods by hand such as burgers. The food holder is of one-piece construction, which allows it to be leak proof. The use of a TPE or silicon rubber allows it to be a tough, multi-use dishwasher proof article.

Figure 5A:
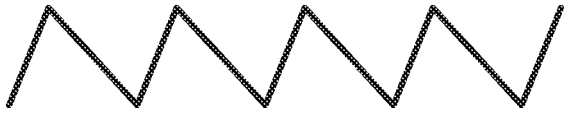
FIGS. 5*a* to 5*d* show alternative corrugation formats.
Figure 5B:
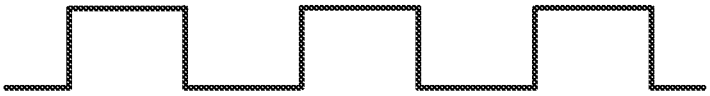
Figure 5C:
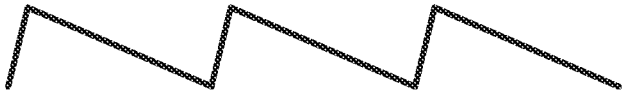
Figure 5D:
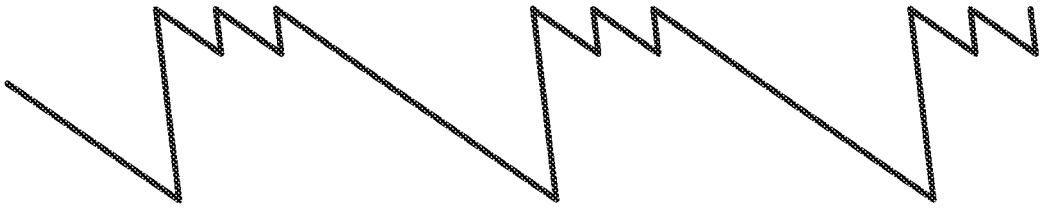

Corrugations could be other shapes, such as zig-zag (as shown in FIG. 5*a*) or square (FIG. 5*b*), or saw tooth (FIG. 5*c*) or double saw tooth (FIG. 5*d*) or any combination or other shape that allows expansion against a resilient force.

Figure 4A:
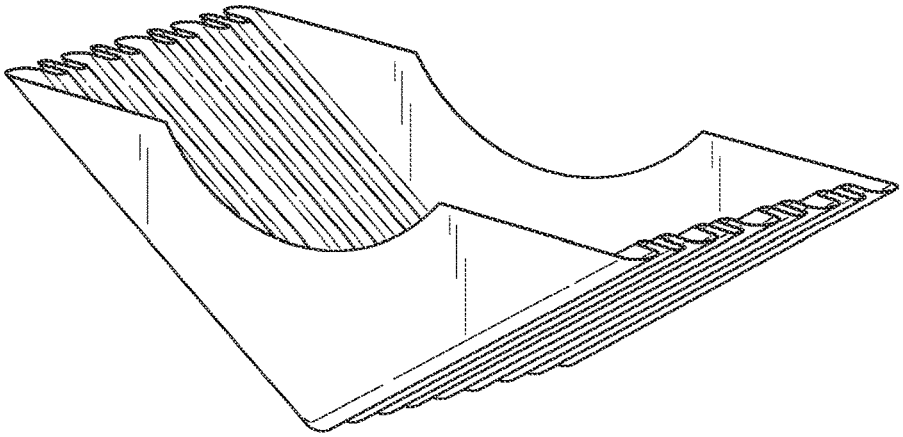
FIGS. 4*a* to 4*c* show embodiments of the invention for holding alternative food types.
Figure 4B:
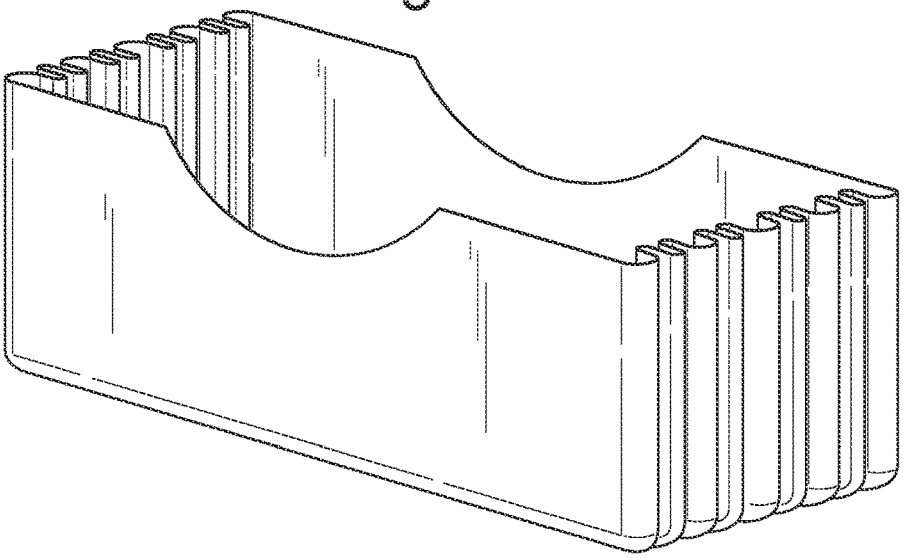
Figure 4C:
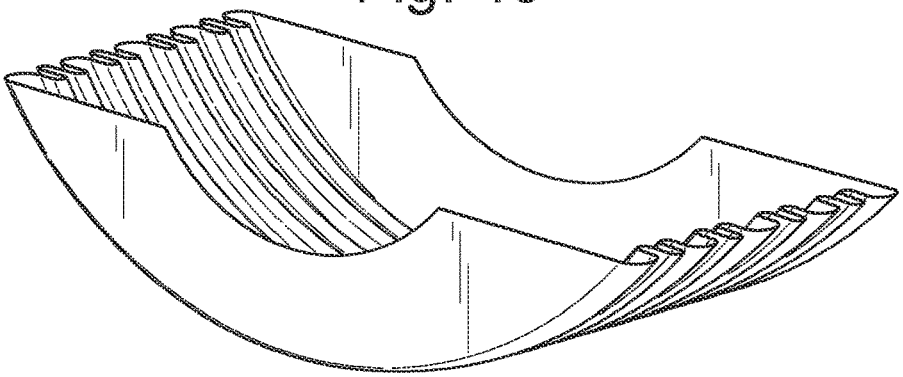

The food holder may be shaped to fit other food items, such as sandwiches, pies, sausage rolls, chicken drumsticks, spring rolls, samosas, pittas, kebabs, hot dogs, wraps and toasties. For holding food items that are square, such as sandwiches, the food holder could be triangular in shape, for triangular cut sandwiches as shown in FIG. 4*a* or square cut sandwiches, the food holder is arranged to be rectangular or square in shape as shown in FIG. 4*b*. For oval shaped food products such as pittas the food holder is oval as shown in FIG. 4*c*.

The invention claimed is:

1. A food holder having first and second opposing planar sides, joined by a gusset which extends from the first opposing planar side to the second opposing planar side, the gusset having resilient corrugations of resilient material, where the corrugations are arranged to provide, in use, a compressive force to hold the food in place and wherein each of the first and second opposing sides has an open edge and at least one closed edge, wherein the gusset joins the first and second opposing sides together along at least one closed edge, wherein the gusset is arranged to allow all of the edges of the first and second opposing planar sides to move towards and away from each other in a direction which is perpendicular to each of the first and second opposing planar sides, wherein the food holder is of one-piece construction, wherein each corrugation is semi-circular in a plane parallel to the first and second opposing planar sides, and wherein the proportions of adjacent corrugations are different, wherein each of the first and second planar opposing sides has a concave notch for exposing a food item in use.

2. A food holder in accordance with claim 1, wherein a rim is provided around the notch, wherein the rim is of thickness greater than the rest of each of the first and second opposing planar sides.

3. A food holder in accordance with claim 1, wherein each of the first and second opposing planar sides has protrusions to stabilize the container when resting on the gusset.

4. A food holder in accordance with claim 1, wherein the corrugations are arranged sequentially between the first and second planar opposing sides, wherein alternate corrugations are equal in width and adjacent corrugations differ in width by a factor of at least 1.5.

5. A food holder in accordance with claim 1, wherein the container is made from silicon rubber or a thermoplastic elastomer.

6. A method of using a food holder having two opposing planar sides, joined by a gusset, the gusset having resilient corrugations of resilient material, where the corrugations are arranged to provide, in use, a compressive force to hold the food in place and wherein each of the opposing sides has an open edge and at least one closed edge, wherein the gusset joins the sides together along at least one closed edge, wherein the gusset is arranged to allow all of the edges of the opposing sides to move towards and away from each other, wherein the food holder is of one-piece construction, wherein each corrugation is semi-circular in a plane parallel to the planar opposing sides, and wherein the proportions of adjacent corrugations are different, wherein the method comprises the steps of separating the two opposing sides of the food holder, inserting a food item between the two opposing sides, and releasing the two opposing planar sides to allow the resilient corrugations to compress the two opposing planar sides of the food holder to grip the inserted food item while exposing the food item for consumption.

* * * * *